US008056649B2

(12) United States Patent
Treviranus et al.

(10) Patent No.: US 8,056,649 B2
(45) Date of Patent: Nov. 15, 2011

(54) APPARATUS AND METHODS FOR DRILLING WELLBORES THAT UTILIZE A DETACHABLE REAMER

(75) Inventors: Joachim Treviranus, Winsen/Aller (DE); Sven Kreuger, Winsen/Aller (DE)

(73) Assignee: Baker Hughes Incorporated, Houston, TX (US)

( * ) Notice: Subject to any disclaimer, the term of this patent is extended or adjusted under 35 U.S.C. 154(b) by 165 days.

(21) Appl. No.: 12/200,686

(22) Filed: Aug. 28, 2008

(65) Prior Publication Data

US 2009/0057015 A1 Mar. 5, 2009

Related U.S. Application Data

(60) Provisional application No. 60/969,048, filed on Aug. 30, 2007.

(51) Int. Cl.
*E21B 7/08* (2006.01)
*E21B 10/26* (2006.01)

(52) U.S. Cl. ..... 175/61; 175/171; 175/257; 175/386

(58) Field of Classification Search ..... 166/61, 166/171, 257, 386
See application file for complete search history.

(56) References Cited

U.S. PATENT DOCUMENTS

| | | | | |
|---|---|---|---|---|
| 3,131,778 | A | 5/1964 | Emerson et al. | |
| 5,472,057 | A * | 12/1995 | Winfree | 175/57 |
| 5,662,182 | A | 9/1997 | McLeod et al. | |
| 5,845,722 | A * | 12/1998 | Makohl et al. | 175/101 |
| 6,106,200 | A * | 8/2000 | Mocivnik et al. | 405/259.5 |
| 6,196,336 | B1 | 3/2001 | Fincher et al. | |
| 6,626,244 | B2 * | 9/2003 | Powers | 166/373 |
| 7,416,036 | B2 * | 8/2008 | Forstner et al. | 175/385 |
| 7,520,343 | B2 * | 4/2009 | Hughes et al. | 175/257 |
| 2002/0007970 | A1 * | 1/2002 | Terry et al. | 175/92 |
| 2002/0066598 | A1 * | 6/2002 | Rozendaal et al. | 175/53 |
| 2003/0047317 | A1 * | 3/2003 | Powers | 166/373 |
| 2004/0256157 | A1 * | 12/2004 | Tessari et al. | 175/57 |
| 2005/0236187 | A1 | 10/2005 | Chen et al. | |
| 2006/0237234 | A1 | 10/2006 | Dennis et al. | |
| 2007/0034412 | A1 * | 2/2007 | Forstner et al. | 175/320 |
| 2009/0266614 | A1 * | 10/2009 | Meister | 175/57 |

FOREIGN PATENT DOCUMENTS

| | | |
|---|---|---|
| GB | 215051 | 5/1924 |
| GB | 2356417 | 5/2001 |
| WO | 2004104360 A2 | 2/2004 |

* cited by examiner

*Primary Examiner* — Jennifer H Gay
(74) *Attorney, Agent, or Firm* — Cantor Colburn LLP

(57) ABSTRACT

An apparatus for use in a wellbore is provided that in one aspect includes: a drilling assembly configured to carry a first drill bit at an end thereof, a second drill bit disposed uphole of the first drill bit, and a connection device that is configured to selectively connect the second drill bit to the drilling assembly and disconnect the second drill bit from the drilling assembly.

20 Claims, 3 Drawing Sheets

APPARATUS AND METHODS FOR DRILLING WELLBORES THAT UTILIZE A DETACHABLE REAMER

CROSS-REFERENCE TO RELATED APPLICATION

This application takes priority from U.S. Patent Application Ser. No. 60/969,048, filed on Aug. 30, 2007.

BACKGROUND INFORMATION

1. Field of the Disclosure

This disclosure relates generally to apparatus and methods that use a liner and reaming bit for drilling wellbores.

2. Background Art

Oil wells (also referred to as "wellbores") are drilled with a drill string that includes a tubular member having a drilling assembly with a drill bit at its bottom end. The tubular member is generally either a jointed pipe or coiled tubing. After the well or a section of the wellbore has been drilled, it is lined with a casing (also referred to as the liner). However, sometimes the liner is placed outside a portion of the drill string and may include a second drill bit, referred to as the reamer drill bit or reamer, above or uphole of the drill bit at the drilling assembly bottom (also referred to as the "pilot" drill bit). The pilot drill bit drills a bore with a certain diameter and the reamer enlarges this bore to the desired wellbore diameter.

It is often desirable to selectively engage and disengage the reamer from the drill string so that the drill string can be retrieved from the wellbore and redeployed without retrieving the reamer or the liner. In the above-noted drilling assembly configuration, the reamer may be placed meters above the pilot drill bit. However, it is often desired to place the reamer relatively close to the pilot drill bit so as to more effectively steer the drilling direction.

The disclosure herein provides improved apparatus and methods for drilling wellbores with a drill string that includes a reamer and a liner.

SUMMARY

Apparatus and methods for drilling wellbores using a reamer and a liner are disclosed. In one aspect, the apparatus may include: a drilling assembly configured to carry a first drill bit at an end thereof; a second drill bit disposed around a portion of the drilling assembly uphole of the first drill bit and a connection device configured to selectively connect the second drill bit to the drilling assembly and disconnect the second drill bit from the drilling assembly.

In another aspect, a method for drilling a wellbore is provided, which may include: conveying a drill string in the wellbore that includes a drilling assembly that has a first drill bit at an end thereof and a second drill bit disposed outside the drilling assembly; and selectively connecting the second drill bit with the drill string and disconnecting the second drill bit from the drill string so that the drilling assembly is retrievable from the wellbore when the second drill bit is disconnected from the drilling assembly without the removal of the second drill bit from the wellbore.

Examples of the more important features of the apparatus and method for drilling a wellbore with a drill string that utilizes a detachable reamer are summarized rather broadly in order that the detailed description thereof that follows may be better understood, and in order that the contributions to the art may be appreciated. There are additional features of the apparatus and method described hereinafter, which will form the subject of the claims appended hereto. An abstract is provided herein to satisfy certain regulatory requirements. The summary and the abstract are not intended to limit the scope of any claims in this application or an application that may take priority from this application.

BRIEF DESCRIPTION OF THE DRAWINGS

For detailed understanding of the present disclosure, references should be made to the following detailed description, taken in conjunction with the accompanying drawings, in which like elements have generally been given like numerals and wherein.

DETAILED DESCRIPTION

Figure 1:
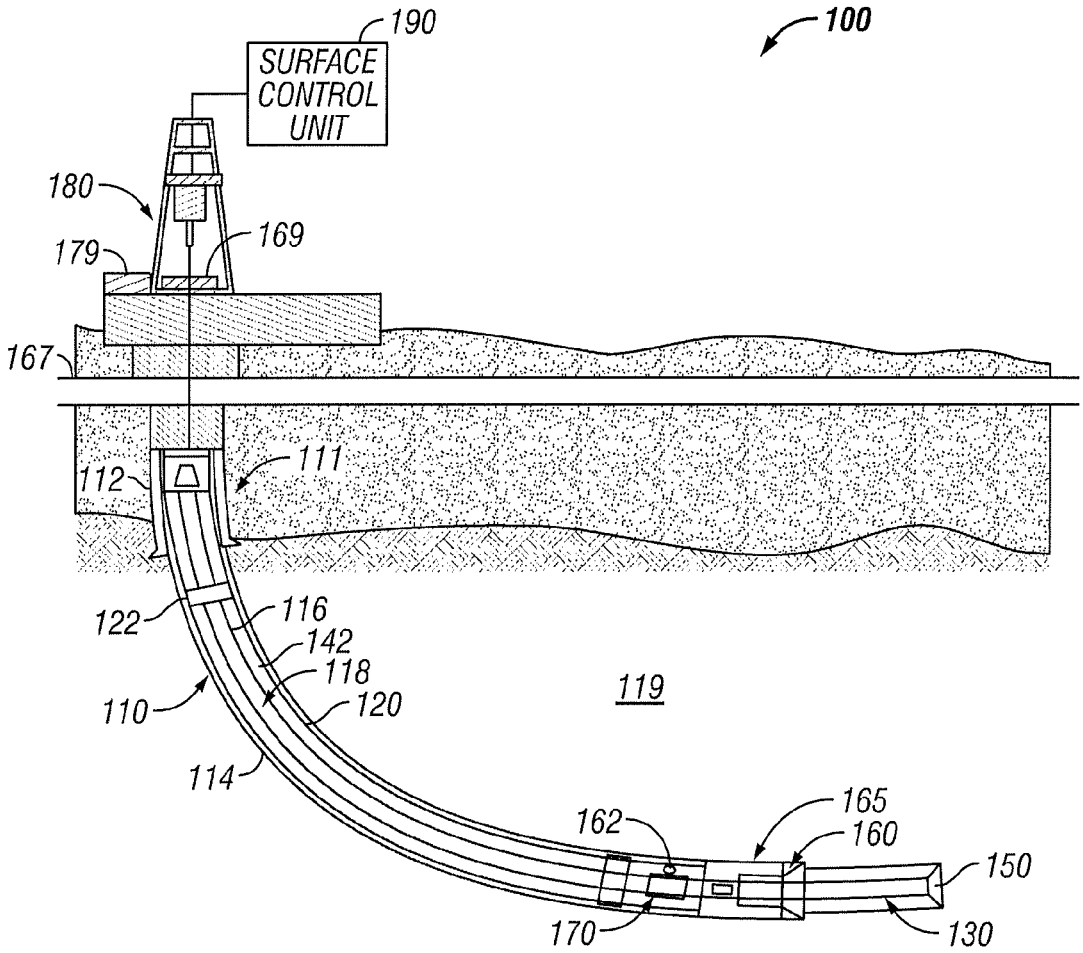
FIG. 1 is a schematic diagram of a wellbore system showing drilling of a wellbore with a drill string that includes a reamer and a liner made according to one embodiment of the disclosure.

FIG. 1 is a schematic diagram showing a drilling system 100 for drilling wellbores according to one embodiment of the present disclosure. FIG. 1 shows a wellbore 110 that includes an upper section 111 with a casing 112 installed therein, and a lower section 114 (which is smaller in diameter than the upper section 111) being drilled with a drill string 118. The drill string 118 includes a tubular member 116 that carries a drilling assembly 130 at its bottom end. The tubular member may be made up by joining drill pipe sections. A drill bit 150 (also referred to herein as the "pilot bit") is attached to the bottom end of the drilling assembly 130 for drilling a bore in the formation 119 of a first (smaller) diameter. A second drill bit 160 (also referred to herein as the "reaming bit" or "reamer") is disposed around a section of the drill string 130 above or uphole of the pilot bit 150. A connection device 170 for selectively engaging the reaming bit with the drill string 118 and for disengaging the reaming bit from the drill string is disposed on the drilling assembly inside a sleeve 162 attached to the reaming bit 160. The operation of the connection device 170 is described later in reference to FIGS. 2-5. A liner 120 is placed outside the drilling tubular 116. The liner 120 is shown hung from a liner hanger 122 coupled to the drill string 118 at a suitable location.

The drill string 118 extends to a rig 180 at the surface 167. A rotary table 169 or a top drive (not shown) may be utilized to rotate the drill string 118 and thus the drilling assembly 130 and the pilot bit 150. The rig 180 also includes conventional devices, such as mechanisms to add additional sections to the liner 120 and the drill pipe 116 as the wellbore 110 is drilled. A control unit 190, which may be a computer-based unit, is placed at the surface 167 for receiving and processing downhole data transmitted by the drilling assembly 130 and for controlling operations of the various devices and sensors in the drilling assembly 130. The controller 190 may include a processor, a storage device for storing data and computer programs. The processor accesses the data and programs from the storage device and executes the instructions contained in the programs to control the drilling operations. A drilling fluid 179 from a source thereof is pumped under pressure through the drilling tubular 116. The drilling fluid 179 discharges at the bottom of the pilot bit 150 and returns to the surface via the annular space 142 between the drill string 118 and the liner 120. Such apparatus and methods are known in the art and are therefore not described in greater detail herein.

Figure 2:
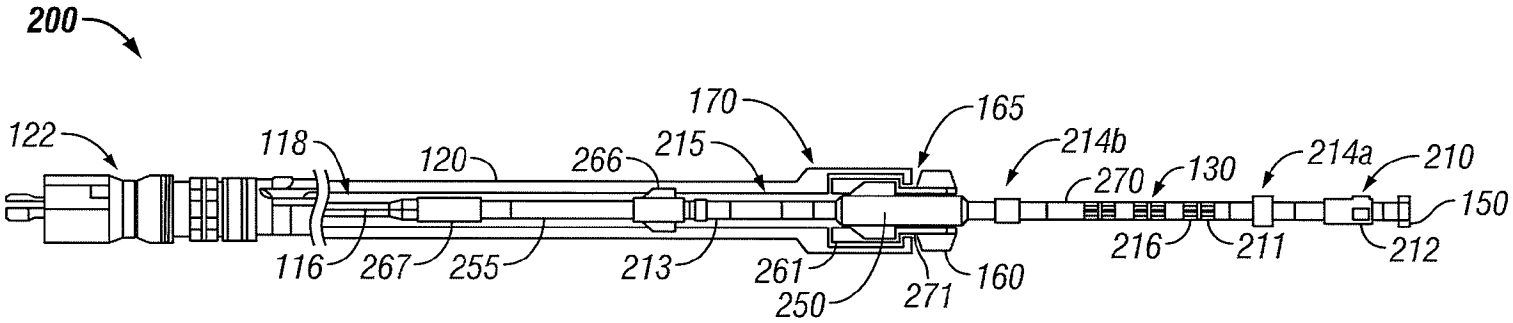
FIG. 2 shows a schematic diagram of a drilling assembly with a reamer and liner made according to one embodiment of the disclosure.

FIG. 2 shows a schematic diagram of a portion 200 of the drill string 118, which portion is shown to include the drilling assembly 130, reamer unit 165 and liner 120 made according to one embodiment of the disclosure. The drilling assembly 130 is shown coupled to the bottom end of the drill pipe 116. The pilot bit 150 is shown attached at the bottom of the drilling assembly 130. The drilling assembly 130 includes a force application device 210 that includes a plurality of independently controlled force application members 212. Each force application member 212 can be extended radially outward from the drilling assembly 130 to apply a desired amount of force on a wall of the wellbore 110 to control the direction of drilling the wellbore.

The drilling assembly 130 may include a number of sensors for determining various drill string and wellbore parameters and formation evaluation devices (generally referred to as the measurement-while-drilling (MWD) sensors or devices) for estimating or determining properties of the formation surrounding the wellbore. In one aspect, the drilling assembly 130 may include a sensor 211 for determining inclination of the drilling assembly and a sensor 216 for determining the position and orientation of the drilling assembly in the wellbore. Such sensors and devices may include, but are not limited to, accelerometers, magnetometers, and gamma ray devices. The MWD devices may include, but are not limited to, acoustic devices, resistivity devices, nuclear devices, and nuclear magnetic resonance devices. Such devices are known in the art and are thus not described in greater detail herein.

One or more stabilizers 214*a* and 214*b* may be deployed at suitable locations on the drilling assembly 130 to provide stabilization to the drilling assembly 130 and the reaming bit 160 during drilling of the wellbore 110. A power generation unit 213 generates power for use by the various sensors and devices associated with the drilling assembly 130. In one aspect, the power unit 213 may include a turbine that is rotated by the drilling fluid 179 flowing in the drilling assembly 130 to generate electrical power. Any other suitable device also may be used to generate the electrical power.

A suitable telemetry unit or device 215 carried by the drilling assembly 130 provides two-way data communication between a downhole control unit or controller 270 and the surface control unit 190. The downhole control unit 270 may include a processor, such as a microprocessor, one or data storage devices (or memory devices) for storing data and computer programs that are used by the processor for processing data downhole and for controlling the operations of the downhole sensors and devices. The individual downhole sensors or devices also may include their own control units. The data storage devices may include any suitable device, including, but not limited to, a read-only memory, random-access memory, flash memory, and disk. Also, any suitable telemetry system may be used for the purpose of this disclosure, including, but not limited to, a mud-pulse telemetry, an acoustic telemetry, an electromagnetic telemetry and a wired-pipe telemetry.

In one aspect, the reamer unit 165 is disposed outside a selected location of the drilling assembly 130. The reamer unit 165 includes the reamer or reaming bit 160 and a sleeve 261 that has a portion 223 having one or more recesses therein, such as recesses 262*a*, 262*b*, that face the drilling assembly 130. The outer dimensions of the reaming bit 160 are larger than the outer dimensions of the pilot bit 150. Therefore, the reaming bit 160 drills the wellbore 110 behind or uphole of the pilot bit of a larger diameter than wellbore drilled by the pilot bit 150. The liner 120 is placed outside the drilling tubular 116. The liner 120 may include a liner shoe or stabilizer 222 at its lower end for providing stabilization to the liner 120 and the reaming bit 160 during drilling of the wellbore 110. The stabilizer 222 may enclose the sleeve recesses 262*a* and 262*b*. A landing shoe 266 may be used to engage and disengage the liner 120 with the drilling tubular 116. A thruster 267 may be used to compensate for the length of the liner 120 in the wellbore 110. Such devices are known for use with the liners and are thus not disclosed herein in greater detail. Radial bearings 256*a* and 256*b* may be provided for wear protection.

Figure 3:
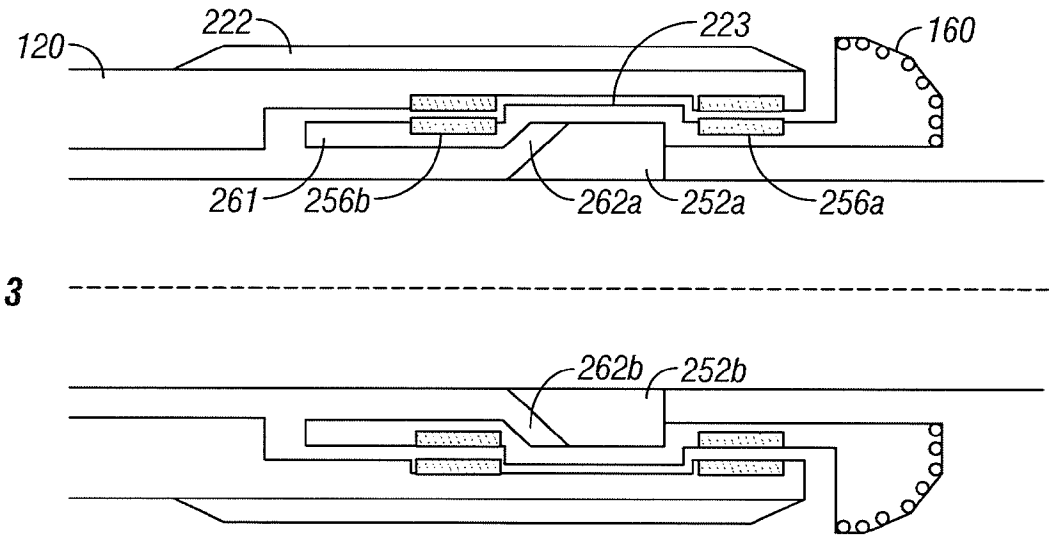
FIG. 3 shows an exploded view of a portion of the connection device shown in FIG. 2.
Figure 4:
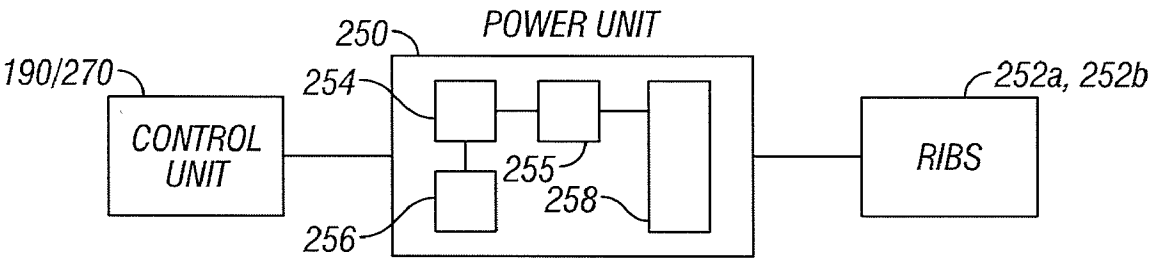
FIG. 4 shows certain components of a power unit that may be utilized for engaging and disengaging the connection device shown in FIGS. 2, 3 and 5.

The reamer unit 165 may be connected to and disconnected from the drilling assembly 130 by a connection device 170. The operation of the connection device 170 may be controlled by a control unit associated with the drilling assembly 130, such as the control unit 270 or by the surface control unit 190 or a combination thereof. Referring to FIGS. 3 and 4, the connection device 170, in one aspect, may include expandable members or splines 252*a*, 252*b* to form a radial and coaxial connection. In one aspect, the connection device 170 may include a power unit 250 that moves one or more members, such as pistons, sliding members, etc., which in turn move the rib members 252*a* and 252*b* radially outward. In one aspect, the power unit 250 may include a motor 254 that drives a pump 255 that supplies fluid under pressure to a piston 258 that moves the rib members 252*a* and 252*b*. In another aspect, the motor 254 may rotate a linear device 256, such a screw-type mechanism, to drive a member, such as a wedge, to move the rib members 252*a* and 252 radially outward. In this case a linear motion of a first member is converted into a radial motion of a second member. Reversing the pump direction or the motor direction, as the case may be, retracts the rib members 252*a*, 252*b* toward the drilling assembly 130. A sensor 271 associated with the connection device 170 provides signals to a circuit or to the controller 270 representative of the movement or extension of the rib members 252*a* and 252*b*. The controller 270 determines the position of the rib members 252*a* and 252*b* to ensure that they are properly engaged with the reamer unit 165. Any suitable sensor may be utilized as the sensor 271, including, but not limited to, a linear potentiometer-type sensor that provides signals proportional to the movement of the piston or the screw member that moves the rib members 252*a* and 252*b*. In one aspect, a single member may be adequate to move or extend all the rib members simultaneously and to an equal radial distance. In such a case a single, sensor may be utilized to determine the extension of the ribs 252*a* and 252*b*.

In operation, when the connection device 170 engages the reamer unit 165 with the drilling assembly 130, the reaming bit 160 rotates when the drill string 116 rotates to enlarge the wellbore drilled by pilot bit 150. When the connection device 170 disengages the drilling assembly 130 from the reaming bit 160, the drill string 118 is free to be moved out of the wellbore (or tripped out of the wellbore) without removing the reaming bit 160 or the liner 120. Thus, this selective engaging and disengaging of the reaming bit enables an operator to retrieve and redeploy the drilling assembly 130 in the wellbore 110 without the removal of the reamer unit 165 or the liner. Other mechanisms, such as those driven by the drilling fluid or any other suitable device may be also be used to engage the reamer unit 165 with the drilling assembly 130 or disengage the reamer unit 165 from the drilling assembly 130.

Figure 5:
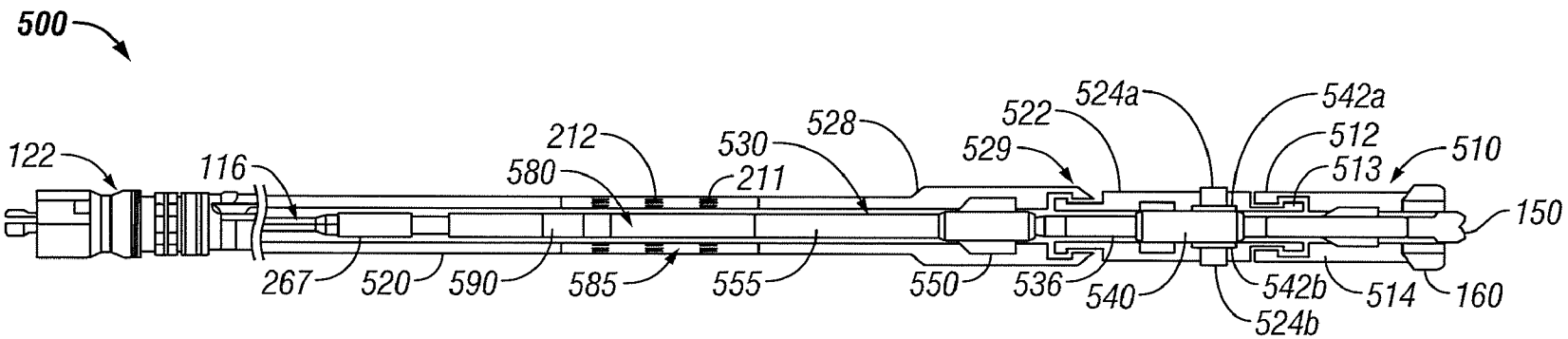
FIG. 5 shows a schematic diagram of another embodiment of a drilling assembly with a reamer and a liner for use in drilling wellbores.

FIG. 5 shows another embodiment of an apparatus 500 for use in the wellbore. The apparatus 500 includes a reamer unit 510 above the pilot drill bit 150 and around a portion of the drilling assembly 530. The reamer unit 510 operates in substantially the same manner as described above in reference to the reamer unit 165 in FIG. 2. In this configuration, the liner 520 includes a liner steering sleeve or liner steering member 522 that is disposed outside a steering device 540 carried by the drilling assembly 530. The liner steering sleeve 522 is connected to the sleeve 514 of the reamer unit 510 via a key member 512 in the reamer unit sleeve and a matching key member 513 in the liner steering sleeve 522. The steering device 540 includes force application members, such as members 542*a* and 542*b* that extend radially outward from and retract back toward the drilling assembly body. Each force application member 542*a* and 542*b* has a corresponding passive movable member 524*a* and 524*b* in the liner steering sleeve 522. When a particular force application member (542*a*, 542*b*) extends outward from the drilling assembly 130, it pushes its corresponding passive movable member (524*a*, 524*b*) in the liner steering sleeve to contact the wellbore wall. The force exerted by a particular passive member (524*a*, 524*b*) on the wellbore wall is the force exerted by its corresponding force application member. Thus, the force applied on the wellbore wall is controlled by the steering device 540. Each force application member may be independently controlled to apply a desired force on the wellbore wall. The steering device 540 may use a motor and a pump to supply fluid under pressure to a piston that acts as the force application member or the piston may move a rib member that in turn moves a corresponding passive member in the liner steering sleeve as described in reference to FIG. 4. In one configuration, the steering device includes at least three force application members, each having an associated passive movable member in the liner steering sleeve.

Still referring to FIG. 5, the liner 520 is shown to include a stabilizer shoe 528 that provides stabilization to the lower end of the liner, including the liner steering sleeve and the reaming bit 160. The stabilizer shoe 528 may be coupled to the liner steering sleeve 522 by a slot and key arrangement 529. A liner string connection 550 couples the drilling assembly 530 to the liner 520. Rotating the drill string 530 rotates both the pilot bit 150 and the reaming bit 160. A drilling motor 555 may be provided in the drill string 530 to superimpose the rotation of the pilot bit 150 by the drill string 530. A suitable number of sensors and measurement-while-drilling devices, collectively designated by numeral 580, are shown disposed above the drilling motor 555. One or more control units 590 in the drilling assembly 530 may be used to control any desired operation of the drilling assembly 530. Control unit 590 communicates with the surface control unit 190 (FIG. 1) in the manner described in reference to FIGS. 1 and 2. In operation, the pilot bit 150 and reaming bit 160 are used to drill the wellbore 110. The steering device 540 controls the force applied by each of the passive members carried by the liner to control the drilling direction of the wellbore. The drilling assembly 530 is engaged with or disengaged from the reaming unit 510 by the connection devices 512 and 513. The drilling assembly 530 may be retrieved from the wellbore without removing the reamer unit 510 from the wellbore.

Thus, in one aspect an apparatus for use in a wellbore is provided that may include a drilling assembly configured to carry a first drill bit at an end thereof; a second drill bit disposed around a portion of the drilling assembly uphole of the first drill bit and a connection device that selectively connects the second drill bit to the drilling assembly and disconnects the second drill bit from the drilling assembly to enable the removal of the drilling assembly from the wellbore without the removal of the second drill bit from the wellbore.

The apparatus may further include a sleeve attached to the second drill bit and wherein the connection device engages with the sleeve to connect the second drill bit to the drilling assembly and disengages from the sleeve to disconnect the second drill bit from the drilling assembly. Connecting the second drill bit with the drilling assembly enables the second drill bit to rotate when the drill string is rotated and disengaging the second drill bit from the drilling assembly enables the removal of the drilling assembly from the wellbore without the removal of the second drill bit from the wellbore. In one aspect, the connection device includes at least one member that extends radially outward from the drilling assembly to engage with the sleeve and retracts toward the drilling assembly to disengage from the sleeve. The connection device may be any suitable device, including but not limited to a device that includes: (i) a pump that supplies fluid under pressure to a piston that moves a member radially outward from the drilling assembly to engage the second drill bit with the drilling assembly; and (ii) a motor that drives a screw that moves a member radially outward from the drilling assembly to engage the second drill bit with the drilling assembly.

In another aspect, a liner is disposed uphole of the second drill bit. The liner may include a stabilizer to provide stabilization to the reaming bit and the liner. In another aspect, the drilling assembly may include a force application below the reaming bit that includes a plurality of independently controlled force application members that apply desired amounts of force on the wellbore wall to steer the pilot bit along a desired direction. The apparatus further may include a controller that controls the connection device to selectively connect the second drill bit to the drilling assembly and to disconnect the drilling bit from the drilling assembly. The controller may be carried by the drilling assembly or placed at the surface. Alternatively both such controllers may cooperate to control the operation of the connection device. In another aspect, the apparatus includes at least one sensor that provide measurements relating to the movement of the spine members and one of the controllers estimates the radial movement of the rib members to determine whether such members have engaged or disengaged the reaming unit. In another aspect, the drilling assembly includes one or more sensors that provide information about one or more of the drilling direction, formation parameters and wellbore parameters. In another aspect, the drilling assembly may include a force application device that includes a plurality of force application members that extend radially outward from the drilling assembly liner to apply force on the wellbore to drill the wellbore along a selected direction.

In another aspect, the apparatus made according to one aspect of the disclosure may include: a drilling assembly that is configured to carry a first drill bit at an end thereof; a second drill bit disposed around a portion of the drilling assembly uphole of the first drill bit; a liner disposed uphole of the second drill bit around a portion of the drilling assembly; and a force application device coupled to the drilling assembly that moves a plurality of force application members carried by the liner to apply force on the wellbore to alter a drilling direction. The force application device may include a plurality of extendable members carried by the drilling assembly, each causing a corresponding member carried by the liner to apply force on the wellbore to alter direction of drilling of the wellbore.

In another aspect, a method is provided that includes: conveying a drill string in the wellbore that includes a drilling assembly that has a first drill bit at an end thereof and a second drill bit disposed outside of the drilling assembly; and selectively engaging or connecting the second drill bit with the drill string and disengaging or disconnecting the second drill bit from the drill string so that the drilling assembly is retrievable from the wellbore when the second drill bit is disconnected from the drilling assembly without the removal of the second drill bit from the wellbore. Connecting the second drill bit with the drilling assembly may include radially extending at least one member coupled to the drill string to engage with a recess member in a sleeve connected to the second drill bit; and disconnecting the second drill bit comprises retracting the at least one member coupled to the drill string to disengage it from the recess. The method may further include drilling the wellbore with the first and second drill bits simultaneously. The method further may include retrieving the drill string from the wellbore after the wellbore has been drilled and placing the liner in the wellbore. The method may further include selectively applying force on the wellbore during drilling of the wellbore to alter the drilling direction. The force may be applied by force application members carried by the drilling assembly or the liner.

The foregoing description is directed to particular embodiments for the purpose of illustration and explanation. It will be apparent, however, to one skilled in the art that many modifications and changes to the embodiments set forth above may be made without departing from the scope and spirit of the disclosure herein. It is intended that the following claims be interpreted to embrace all such modifications and changes.

What is claimed is:

1. An apparatus for use in a wellbore, comprising:

a drilling assembly carrying a first drill bit at an end thereof and a force application device configured to apply a force on the wellbore to cause the first drill bit to drill the wellbore along a selected direction;

a second drill bit disposed uphole of the force application device with a sleeve of the second drill bit within a liner, wherein the sleeve of the second drill bit is configured to rotate within the liner during drilling of the wellbore; and a connection device on the drilling assembly configured to selectively connect the second drill bit to the drilling assembly uphole of the force application device and disconnect the second drill bit from the drilling assembly.

2. The apparatus of claim 1 wherein the connection device is configured to connect to the sleeve to connect the second drill bit to the drilling assembly and disconnect from the sleeve to disconnect the second drill bit from the drilling assembly.

3. The apparatus of claim 2, wherein the connection device comprises at least one member configured to extend from the drilling assembly to engage with the sleeve and retract toward the drilling assembly to disengage from the sleeve.

4. The apparatus of claim 1, wherein connecting the second drill bit to the drilling assembly enables the second drill bit to rotate when a drill string carrying the drilling assembly is rotated and disengaging the second drill bit from the drilling assembly enables the removal of the drilling assembly from the wellbore without the removal of the second drill bit from the wellbore.

5. The apparatus of claim 1, wherein the connection device is selected from a group consisting of: (i) a pump configured to supply fluid under pressure to a piston that moves a member radially outward from the drilling assembly to engage the second drill bit with the drilling assembly; (ii) a motor configured to drive a first member linearly that moves a second member radially outward from the drilling assembly to engage the second drill bit with the drilling assembly.

6. The apparatus of claim 1 wherein the liner is disposed uphole of the first drill bit and includes a stabilizer.

7. The apparatus of claim 6 further comprising a conveying member configured to carry the drilling assembly and is detachably connected to the liner.

8. The apparatus of claim 6 wherein the force application device that includes at least one member configured to extend radially outward to apply a force on the wellbore to drill the wellbore along a selected direction.

9. The apparatus of claim 1 wherein the a force application device includes a plurality of force application members configured to independently apply force on the wellbore to cause the first drill bit to drill the wellbore along a selected direction.

10. The apparatus of claim 1 further comprising a controller configured to control the connection device to selectively connect the second drill bit to the drilling assembly and to selectively disconnect the drill bit from the drilling assembly.

11. The apparatus of claim 1, wherein the drilling assembly further comprises at least one sensor configured to provide at least one of: (i) a measurement relating to at least one parameter of the formation; and (ii) a measurement relating to a drilling direction.

12. The apparatus of claim 1 further comprising a sensor configured to provide a signal representative of an extension of a member of the connection device that connects the second drill bit to the drilling assembly.

13. A method of drilling a wellbore, comprising:

conveying a drill string in the wellbore that includes a drilling assembly that has a first drill bit at an end thereof, a force application device configured to apply a force on the wellbore to cause the drill bit to drill the wellbore along a selected direction and a second drill bit disposed outside of the drilling assembly with a sleeve of the second drill bit within a liner, wherein the sleeve of the second drill bit rotates within the liner during drilling of the wellbore; and connecting the second drill bit with the drilling assembly uphole of the force application device for drilling the wellbore and disconnecting the second drill bit from the drilling assembly for retrieving the drilling assembly from the wellbore without the removal of the second drill bit from the wellbore.

14. The method of claim 13, wherein:

connecting the second drill bit with the drilling assembly comprises radially extending at least one member coupled to the drill string to engage with a recess member in the sleeve connected to the second drill bit; and disconnecting the second drill bit comprises retracting the at least one member coupled to the drill string to disengage the at least one member from the recess.

15. The method of claim 13 further comprising drilling the wellbore with the first bit of a first diameter and with the second bit of a second diameter that is larger than the first diameter.

16. The method of claim 13, wherein connecting the second drill bit with the drilling assembly is done by a connection device that is selected from a group consisting of: (i) a pump that supplies fluid under pressure to a piston that moves a member radially outward from the drilling assembly to engage the second drill bit with the drilling assembly; and (ii) a motor that drives a first member linearly to move a second member outward from the drilling assembly to engage the second drill bit with the drilling assembly.

17. The method of claim 13 further comprising deploying the liner with a liner shoe uphole of the first drill bit.

18. The method of claim 17 further comprising retrieving the drilling assembly from the wellbore and placing the liner in the wellbore.

19. The method of claim 13 further comprising applying the force on the wellbore during drilling of the wellbore to alter the drilling direction.

20. The method of claim 19, wherein applying the force on the wellbore comprises using a force application device that includes a plurality of members extending from the drilling assembly or the liner, wherein each member is configured to independently apply a desired amount of force on the wellbore during drilling of the wellbore.

* * * * *